US006917334B2

(12) United States Patent
Chen

(10) Patent No.: US 6,917,334 B2
(45) Date of Patent: Jul. 12, 2005

(54) ULTRA-WIDE BAND MEANDERLINE FED MONOPOLE ANTENNA

(75) Inventor: Li Chen, Melbourne, FL (US)

(73) Assignee: SkyCross, Inc., Melbourne, FL (US)

( * ) Notice: Subject to any disclaimer, the term of this patent is extended or adjusted under 35 U.S.C. 154(b) by 68 days.

(21) Appl. No.: 10/418,947

(22) Filed: Apr. 18, 2003

(65) Prior Publication Data

US 2004/0012530 A1 Jan. 22, 2004

Related U.S. Application Data

(60) Provisional application No. 60/343,865, filed on Apr. 19, 2002.

(51) Int. Cl.[7] ..... H01Q 1/38
(52) U.S. Cl. ..... 343/700 MS; 343/829
(58) Field of Search ..... 343/700 MS, 829

(56) References Cited

U.S. PATENT DOCUMENTS 4,847,625 A 7/1989 Dietrich et al.
5,497,164 A 3/1996 Croq
5,680,144 A 10/1997 Sanad
5,757,333 A * 5/1998 Kitchener ..... 343/825
5,790,080 A 8/1998 Apostolos
5,926,137 A 7/1999 Nealy
6,057,802 A 5/2000 Nealy et al.
6,320,544 B1 11/2001 Korisch et al.
6,323,814 B1 11/2001 Apostolos

OTHER PUBLICATIONS

Harvey, A. F.; "Periodic and Guiding Structures at Microwave Frequencies"; IRE Transactions on Microwave Theory and Techniques; Jan. 1960; pp. 30–61.

* cited by examiner

*Primary Examiner*—James Vannucci
(74) *Attorney, Agent, or Firm*—John L. DeAngelis, Jr.; Beusse Brownlee Wolter Mora & Maire, P.A.

(57) ABSTRACT

An ultra-wide bandwidth antenna. The antenna comprises a serially electrically connected top radiator, side radiator and bottom radiator. Geometrically, the top radiator, side radiator and bottom radiator form a U-shaped structure. A meanderline conductor is connected between the bottom radiator and ground. The top radiator is connected to a signal feed.

26 Claims, 14 Drawing Sheets

ULTRA-WIDE BAND MEANDERLINE FED MONOPOLE ANTENNA

This application claims the benefit of the provisional application filed on Apr. 19, 2002, assigned application No. 60/373,865 and entitled, Ultra-wide band meanderline fed monopole antenna.

FIELD OF THE INVENTION

The present invention relates generally to antennas for transmitting and receiving radio frequency signals, and more specifically to such antennas operating over a wide bandwidth of frequencies or at multiple resonant frequencies.

BACKGROUND OF THE INVENTION

It is generally known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity and the radiation pattern. Generally for an operable antenna, the minimum physical antenna dimension (or the electrically effective minimum dimension) must be on the order of a quarter wavelength (or a multiple thereof) of the operating frequency, which thereby advantageously limits the energy dissipated in resistive losses and maximizes the energy transmitted. Quarter wavelength and half wavelength antennas are the most commonly used.

The burgeoning growth of wireless communications devices and systems has created a substantial need for physically smaller, less obtrusive, and more efficient antennas that are capable of wide bandwidth or multiple frequency-band operation, and/or operation in multiple modes (i.e., selectable radiation patterns or selectable signal polarizations). Smaller packaging of state-of-the-art communications devices may not provide sufficient space for the conventional quarter and half wavelength antenna elements. Thus physically smaller antennas operating in the frequency bands of interest and providing the other desirable antenna operating properties (input impedance, radiation pattern, signal polarizations, etc.) are especially sought after.

As is known to those skilled in the art, there is a direct relationship between physical antenna size and antenna gain, at least with respect to a single-element antenna, according to the relationship: gain=$(\beta R)^2+2\beta R$, where R is the radius of the sphere containing the antenna and $\beta$ is the propagation factor. Increased gain thus requires a physically larger antenna, while communications device manufacturers and users continue to demand physically smaller antennas. As a further constraint, to simplify the system design and strive for minimum cost, equipment designers and system operators prefer to utilize antennas capable of efficient multi-frequency and/or wide bandwidth operation, allowing the communications device to access various wireless services operating within different frequency bands from a single antenna. Finally, gain is limited by the known relationship between the antenna frequency and the effective antenna length (expressed in wavelengths). That is, the antenna gain is constant for all quarter wavelength antennas of a specific geometry i.e., at that operating frequency where the effective antenna length is a quarter wavelength of the operating frequency.

The known Chu-Harrington relationship relates the size and bandwidth of an antenna. Generally, as the size decreases the antenna bandwidth also decreases. But to the contrary, as the capabilities of handset communications devices expand to provide for higher data rates and the reception of bandwidth intensive information (e.g., streaming video), the antenna bandwidth must be increased.

One basic antenna commonly used in many applications today is the halfwavelength dipole antenna. The radiation pattern is the familiar omnidirectional donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

The quarter-wavelength monopole antenna placed above a ground plane is derived from a half-wavelength dipole. The physical antenna length is a quarter-wavelength, but with the ground plane the antenna performance resembles that of a half-wavelength dipole. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics. However, conventional loop antennas are too large for handset applications and do not provide multi-band operation. As the loop length increases (i.e., approaching one free-space wavelength), the maximum of the field pattern shifts from the plane of the loop to the axis of the loop. Placing the loop antenna above a ground plane generally increases its directivity.

Given the advantageous performance of quarter and half wavelength antennas, conventional antennas are typically constructed so that the antenna length is on the order of a quarter wavelength of the radiating frequency, and the antenna is operated over a ground plane. These dimensions allow the antenna to be easily excited and operated at or near a resonant frequency, limiting the energy dissipated in resistive losses and maximizing the transmitted energy. But, as the operational frequency increases/decreases, the operational wavelength correspondingly decreases/increases. Since the antenna is designed to present a dimension that is a quarter or half wavelength at the operational frequency, when the operational frequency changes, the antenna is no longer operating at a resonant condition and antenna performance deteriorates.

As can be inferred from the above discussion of various antenna designs, each exhibits know advantages and disadvantages. The dipole antenna has a reasonably wide bandwidth and a relatively high antenna efficiency (or gain). The major drawback of the dipole, when considered for use in personal wireless communications devices, is its size. At an operational frequency of 900 MHz, the half-wave dipole comprises a linear radiator of about six inches in length. Clearly it is difficult to locate such an antenna in the small space envelope associated with today's handheld devices. By comparison, the patch antenna or the loop antenna over a ground plane present a lower profile resonant device than the dipole, but as discussed above, operate over a narrower bandwidth with a highly directional radiation pattern.

As discussed above, multi-band or wide bandwidth antenna operation is especially desirable for use with various personal or handheld communications devices. One approach to producing an antenna having multi-band capability is to design a single structure (such as a loop antenna) and rely upon the higher-order resonant frequencies of the loop structure to obtain a radiation capability in a higher frequency band. Another method employed to obtain multi-band performance uses two separate antennas, placed in proximity, with coupled inputs or feeds according to methods well known in the art. Thus each of the two separate antennas resonates at a predictable frequency to provide operation in at least two frequency bands. Notwithstanding these techniques, it remains difficult to realize an efficient antenna or antenna system that satisfies the multi-band/wide bandwidth operational features in a relatively small physical volume.

In an effort to overcome some of the disadvantages associated with the use of monopole, dipole, loop and patch antennas as discussed above, antenna designers have turned to the use of so-called slow wave structures where the antenna physical dimensions are not equal to its effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one in which the phase velocity of the traveling wave is less than the free space velocity of light. The wave velocity is the product of the wavelength and the frequency and takes into account the material permittivity and permeability, i.e., $c/((\mathrm{sqrt}(\in_r)\mathrm{sqrt}(\mu_r))=\lambda f$. Since the frequency remains unchanged during propagation through a slow wave structure, if the wave travels slower (i.e., the phase velocity is lower) than the speed of light in a vacuum, the wavelength within the structure is lower than the free space wavelength. Thus, for example, a half wavelength slow wave structure is shorter than a half wavelength conventional structure where the wave propagates at the speed of light (c). The slow-wave structure de-couples the conventional relationship between physical length, resonant frequency and wavelength. Slow wave structures can be used as associated antenna elements (i.e., feeds) or as antenna radiating structures.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating the slow wave will be physically smaller than the structure propagating the wave at the speed of light.

Slow wave structures are discussed extensively by A. F. Harvey in his paper entitled *Periodic and Guiding Structures at Microwave Frequencies*, in the IRE Transactions on Microwave Theory and Techniques, January 1960, pp. 30–61 and in the book entitled *Electromagnetic Slow Wave Systems* by R. M. Bevensee published by John Wiley and Sons, copyright 1964. Both of these references are incorporated by reference herein.

A transmission line or conductive surface overlying a dielectric substrate exhibits slow-wave characteristics, such that the effective electrical length of the slow-wave structure is greater than its actual physical length, according to the equation, $$1_e=(\in_{eff}^{1/2})\times 1_p,$$

where $1_e$ is the effective electrical length, $1_p$ is the actual physical length, and $\in_{eff}$ is the dielectric constant ($\in_r$) of the dielectric material proximate the transmission line.

A prior art meanderline, which is one example of a slow wave structure, comprises a conductive pattern (i.e., a traveling wave structure) over a dielectric substrate, overlying a conductive ground plane. An antenna employing a meanderline structure, referred to as a meanderline-loaded antenna or a variable impedance transmission line (VITL) antenna, is disclosed in U.S. Pat. No. 5,790,080. The antenna consists of two vertical spaced apart conductors and a horizontal conductor disposed therebetween, with a gap separating each vertical conductor from the horizontal conductor.

The antenna further comprises one or more meanderline variable impedance transmission lines bridging the gap between the vertical conductor and each horizontal conductor. Each meanderline coupler is a slow wave transmission line structure carrying a traveling wave at a velocity lower than the free space velocity. Thus the effective electrical length of the slow wave structure is greater than its actual physical length. Consequently, smaller antenna elements can be employed to form an antenna having, for example, quarter-wavelength properties. As for all antenna structures, the antenna resonant condition is determined by the electrical length of the meanderlines plus the electrical length of the radiating elements.

The meanderline-loaded antenna allows the physical antenna dimensions to be reduced, while maintaining an effective electrical length that, in one embodiment, is a quarter wavelength multiple. The meanderline-loaded antennas operate near the known Chu-Harrington limits, that is, $$\text{efficiency}=FVQ,$$

where: Q=quality factor

V=volume of the structure in cubic wavelengths

F=geometric form factor (F=64 for a cube or a sphere)

Meanderline-loaded antennas achieve this efficiency limit of the Chu-Harrington relation while allowing the effective antenna length to be less than a quarter wavelength at the resonant frequency. Dimension reductions of 10 to 1 can be achieved when compared to a quarter wavelength monopole antenna, while achieving a comparable gain.

BRIEF SUMMARY OF THE INVENTION

An antenna according to the teachings of the present invention presents a relatively small space requirement and provides improved bandwidth performance. The antenna comprises top and bottom substantially parallel planar elements wherein the top planar element extends beyond the bottom planar element. A side planar element is disposed substantially perpendicular to and interconnects an edge of the top planar element and an edge of the bottom planar element. A first end of a meanderline conductor is connected to the free edge of the bottom planar element. The meanderline conductor further comprises a second end for connection to a ground plane. An open edge of the top planar element is connected to a source terminal for receiving signals when the antenna is operative in the receiving mode and for supplying signals to be transmitted when the antenna is operative in the transmitting mode.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
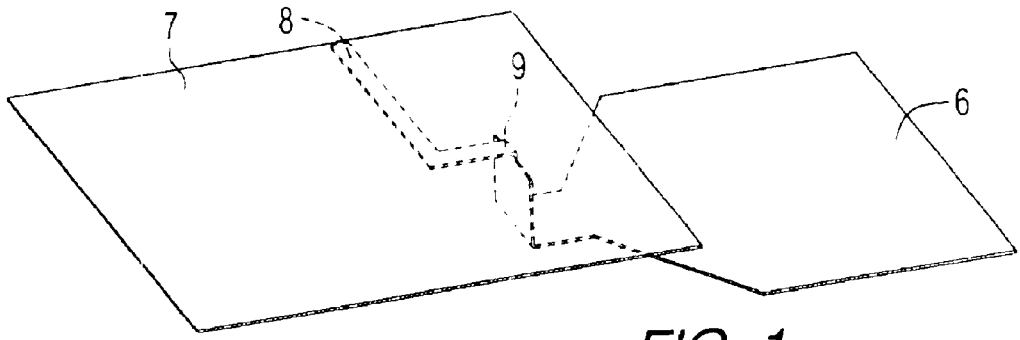
FIG. 1 PRIOR ART
FIG. 1 illustrates a prior art monopole antenna disposed a ground plane.

Before describing in detail the particular ultra wideband antenna in accordance with the present invention, it should be observed that the present invention resides primarily in a novel combination of elements. Accordingly, the elements have been represented by conventional elements in the drawings, showing only those specific details that are pertinent to the present invention, so as not to obscure the disclosure with structural details that will be readily apparent to those skilled in the art having the benefit of the description herein.

FIG. 1 illustrates a prior art monopole antenna 6 electrically connected to an disposed overlying a ground plane 7, with a feed conductor 8 connected to a source feed terminal 9 of the antenna 6. The antenna 6 operates as a conventional monopole antenna above a ground plane as described above.

Figure 2:
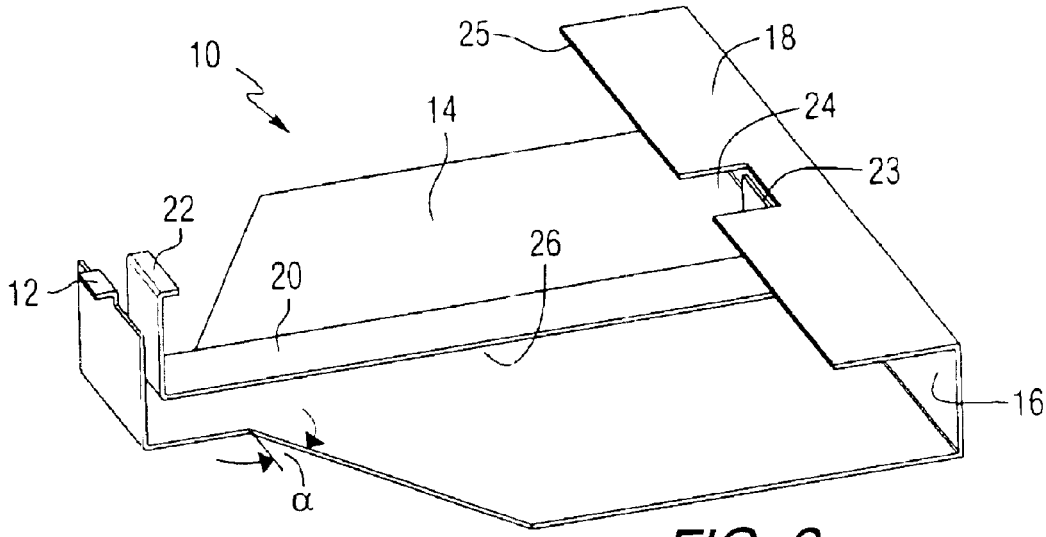
FIGS. 2 through 4 illustrate various views of an antenna constructed according to the teachings of the present invention.
Figure 3:
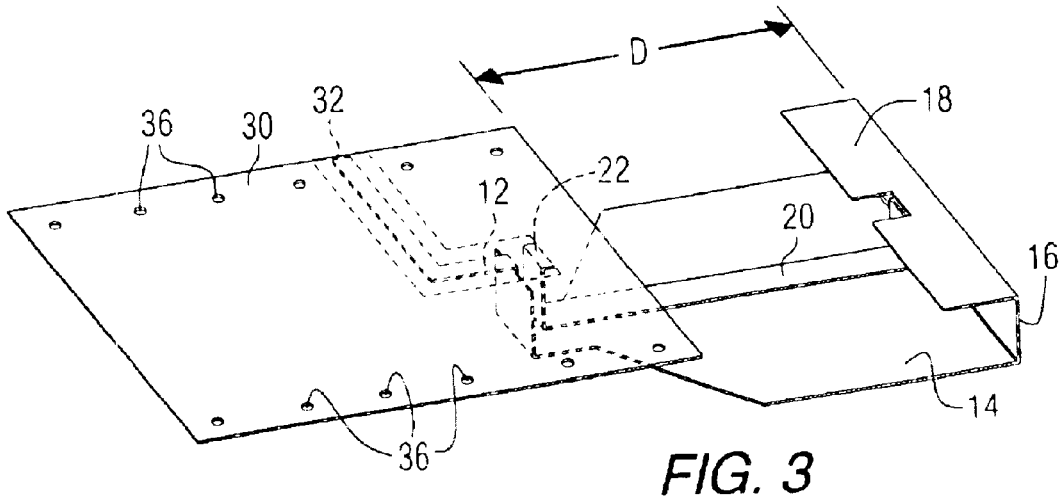

An antenna constructed according to the teachings of the present invention includes the aforementioned meanderline structures and a plurality of radiating elements, forming an antenna with ultra-wide bandwidth characteristics. One embodiment of such an antenna 10 constructed according to the teachings of the present invention is illustrated in FIGS. 2 and 3. FIG. 2, which is a perspective bottom view, illustrates the arrangement and serial interconnections of a source terminal 12, a top radiator 14, a side radiator 16, a bottom radiator 18, a meanderline 20 (i.e., a slow wave structure) and a ground terminal 22. The top radiator 14 operates as a monopole antenna above a ground plane, with the side radiator 16 and the bottom radiator 18 providing additional radiating surfaces at certain frequencies.

The meanderline 20 is connected to the bottom radiator 18 along an edge 23 of a notch 24 formed in the bottom radiator 18. Use of the notch 24 allows increased physical length for the meanderline 20, thus increasing the antenna electrical length and the antenna bandwidth. In an embodiment operating over a narrower bandwidth, the additional physical length provided by the notch 24 may not be required. Instead, in such an embodiment the meanderline 20 is connected to an edge 25 of the bottom radiator 18.

In the embodiment of FIG. 2, an air gap 26 formed between the meanderline 20 and the top radiator 14 serves as the dielectric medium for the meanderline 20. In another embodiment the gap is filled with a dielectric material other than air to impart different slow wave characteristics to the signal carried over the meanderline 20, and thus different characteristics to the antenna 10.

The antenna 10 and an accompanying ground plane 30 are illustrated in the bottom view of FIG. 3. As shown, a signal feed 32 connected to the source terminal 12, is disposed on the hidden surface of the ground plane 30 for providing a signal to associated receiving equipment (not shown) when the antenna 10 is operative in the receiving mode, and for providing a signal from associated transmitting equipment (not shown) for transmission when the antenna 10 is operative in the transmitting mode. The signal feed 32 can terminated in a suitable coupling termination (not shown) for connection to the associated receiving and transmitting equipment.

As shown in FIG. 3, the ground terminal 22 is connected to the ground plane 30. In one embodiment the ground plane 30 is formed from conductive material disposed on opposing surfaces of a dielectric substrate. For example, the substrate comprises conventional printed circuit board material having a dielectric core and a conductive material layer on opposing core surfaces. The conductive material layer on the two surfaces is electrically connected by one or more conductive vias 36, forming the ground plane 30.

In a preferred embodiment the side radiator 16 is perpendicular to both the top radiator 14 and the bottom radiator 18. In this embodiment, the source terminal 12 and the ground terminal 22 are substantially co-planar with the bottom radiator 18. Thus the width of the side radiator 16 effectively determines the distance between the top radiator 14 and the ground plane 30.

In one embodiment, the antenna 10 is constructed from planar conductive sheet material that is formed into a final shape substantially as described herein. The structure is relatively simple, easily manufactured using known metal stamping and bending processes, and thus offers a low cost wide bandwidth antenna solution for communications devices operative over a wide frequency band or operative on several adjacent frequency bands.

It has been determined that the total antenna length (that is, the sum of the effective electrical length of the top radiator 14, the side radiator 16, the bottom radiator 18 and the meanderline 20) is about one-seventh of a wavelength at the lowest resonant frequency. However, this wavelength/frequency does not necessarily define the lower edge of the operative frequency band.

The meanderline 20 operates as a tuning element for the antenna 10 such that the effective electrical length of the meanderline 20, operating as a slow wave structure, affects the antenna operating bandwidth. The meanderline 20 emits and receives little energy.

The length of the bottom radiator 18 has been shown to primarily affect antenna performance at lower frequencies. As the length is reduced the low frequency performance deteriorates. In a preferred embodiment, the length of the bottom radiator 18 is about 20% to 30% of the top radiator length.

In a preferred embodiment, the angle a in FIG. 2 is about 20°.It has been determined that this angle can be varied to affect performance at higher frequencies. Generally, decreasing the angle improves performance at higher frequencies while limiting performance at lower frequencies. Thus the angle is selected based on the desired frequency performance of the antenna 10.

In one embodiment the antenna height, which has been found to primarily affect performance at the lower frequencies, is about 8 mm. Thus the antenna 10 presents a low profile, suitable for use with handheld communications devices where available space is limited. The input impedance of the antenna 10 is approximately 50 ohms.

The antenna 10 extends the low frequency performance for the same physical dimensions as the prior art monopole antenna operating above a ground plane as shown in FIG. 1. For example, assuming antenna dimensions of about 36 mm by 33 mm by 8 mm disposed over a ground plane of about 54 mm by 85 mm, the edge of the lower resonant band for a conventional prior art monopole antenna is about 1.2 GHz, with a bandwidth of about 1 GHz (i.e., from about 1.2 to about 2.2 GHz). The antenna 10 constructed according to the teachings of the present invention exhibits a lower resonant frequency of about 800 MHz and a bandwidth of about 1.8 GHz, i.e., from 0.8 to 2.6 GHz.

It has been determined that the dimension "D" in FIG. 3 significantly contributes to the low frequency performance of the antenna 10. Increasing the distance "D" lowers the resonant frequencies of the antenna and thus improves the low frequency performance. Decreasing "D" induces coupling between the bottom radiator 18 and the ground plane 30, which degrades the low frequency performance. As can be seen, however, increasing "D" also increases the space occupied by the antenna 10 within a communications device. In one embodiment, the distance "D" is about 25 mm and the low frequency performance extends to about 800 MHz.

Figure 4:
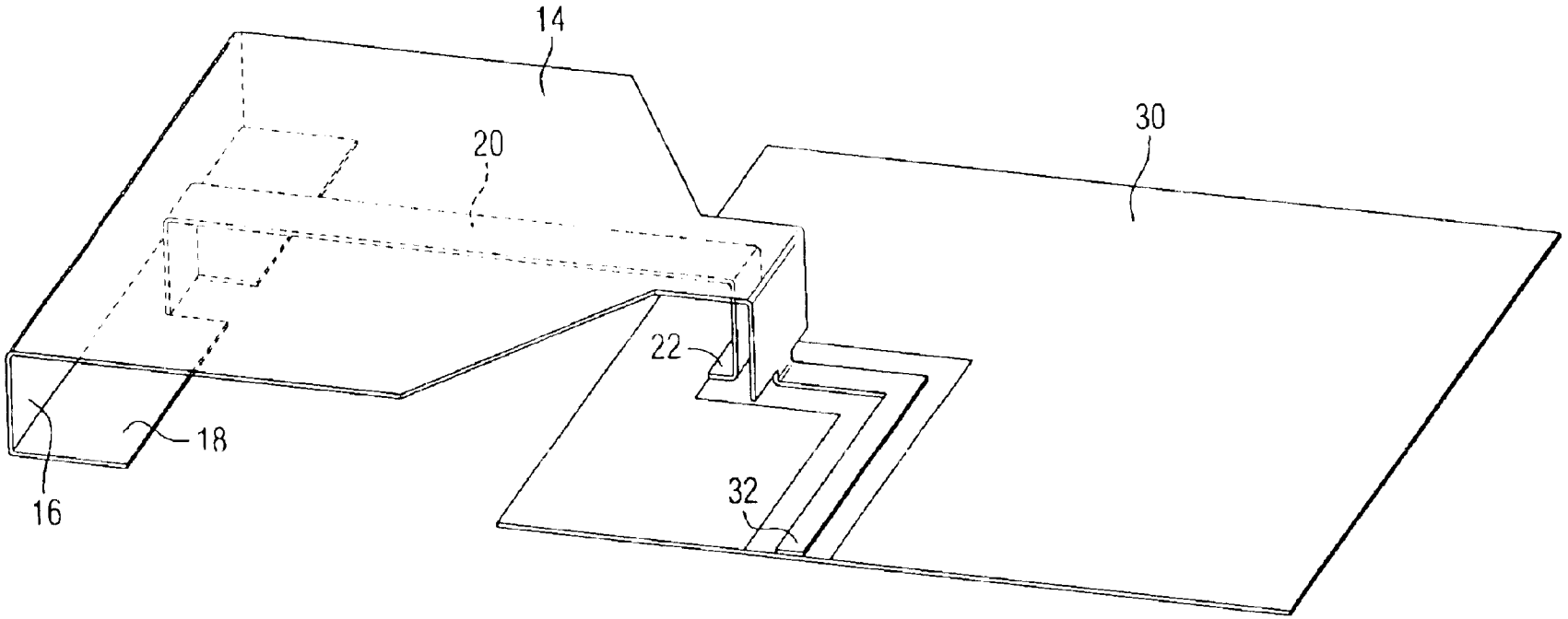

FIG. 4 is a side perspective view of the antenna 10 of the present invention and the ground plane 30. The top radiator 14 is connected to the signal feed line 32 via the source terminal 12, and the meanderline 20 is connected to the ground plane 30 via the ground terminal 22.

Various operational characteristics of the antenna 10 are depicted in FIGS. 5 through 15, including illustrative comparisons of a prior art monopole above a ground plane, as in FIG. 1, and the antenna 10 constructed according to the teachings of the present invention.

Figure 5:
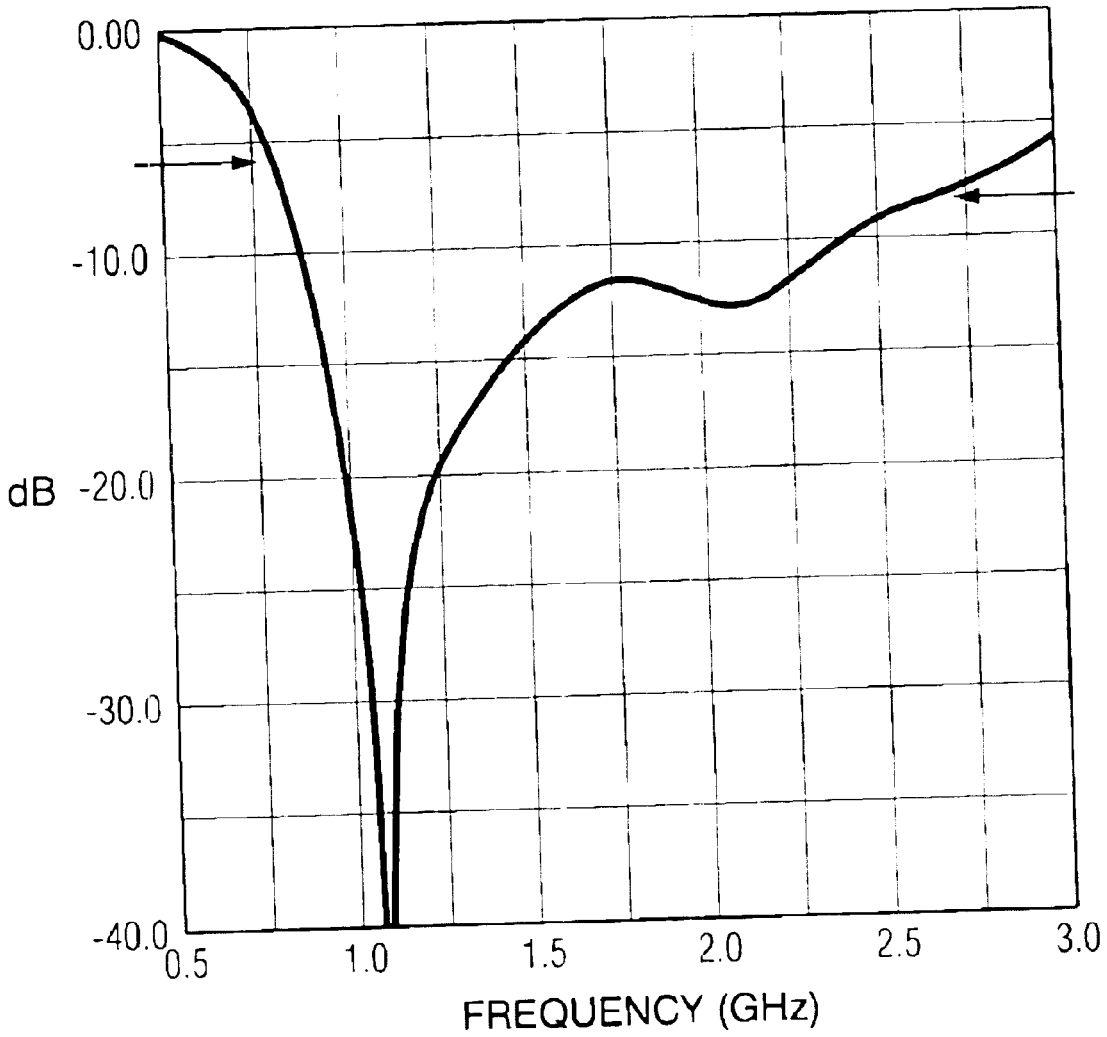
FIGS. 5 through 16 graphically illustrate various performance parameters associated with the antenna constructed according to the teachings of the present invention.

As shown by the return loss plot in FIG. 5, the bandwidth of the ultra-wide bandwidth antenna 10 ranges from about 800 to about 2700 MHz, as defined by the frequency band where the voltage standing wave ratio is less than about 2.5 to 1.

Figure 6:
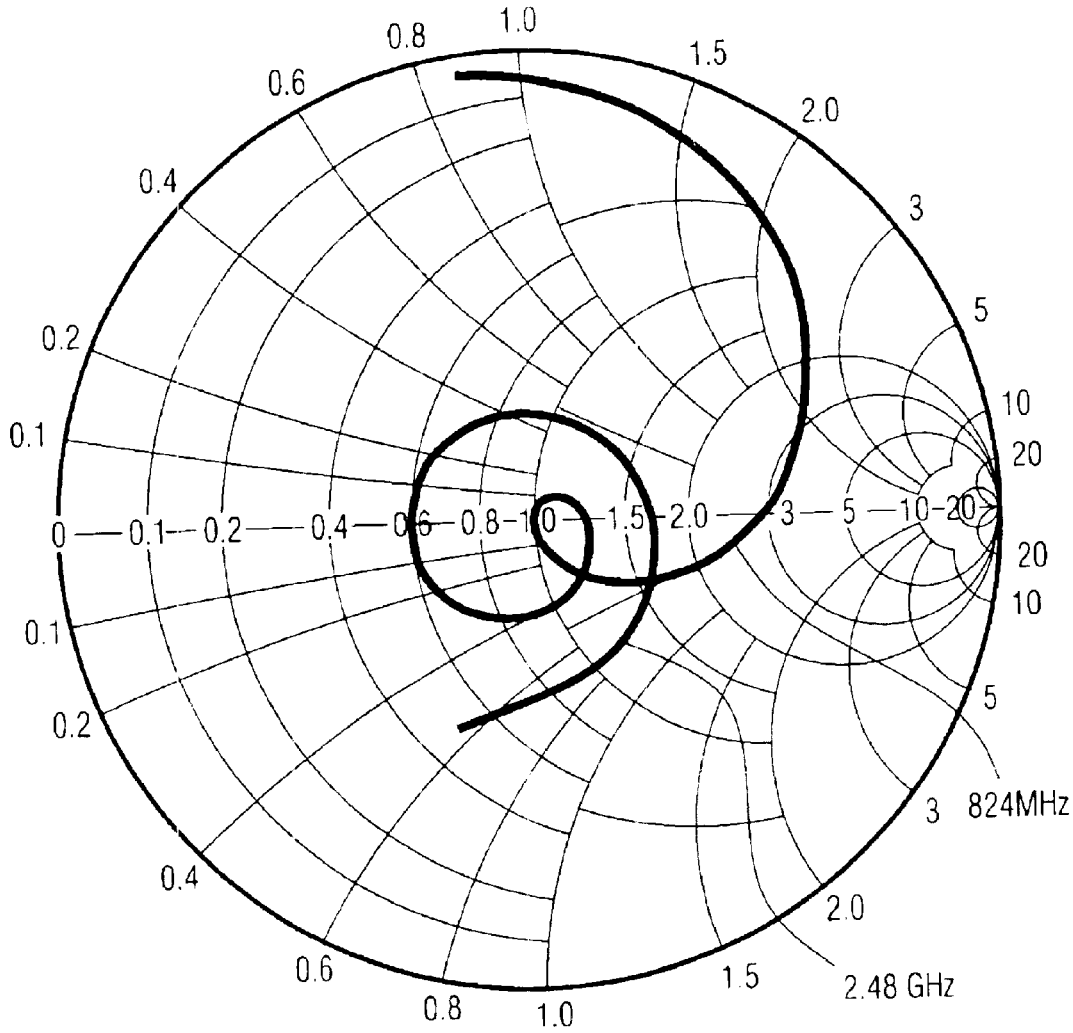

FIG. 6 is a Smith chart illustrating the voltage standing wave ratio of the antenna 10, noting in particular the characteristics at the indicated frequencies of about 824 MHz and 2.48 GHz.

Figure 7:
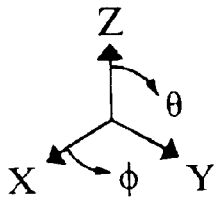
Figure 8:
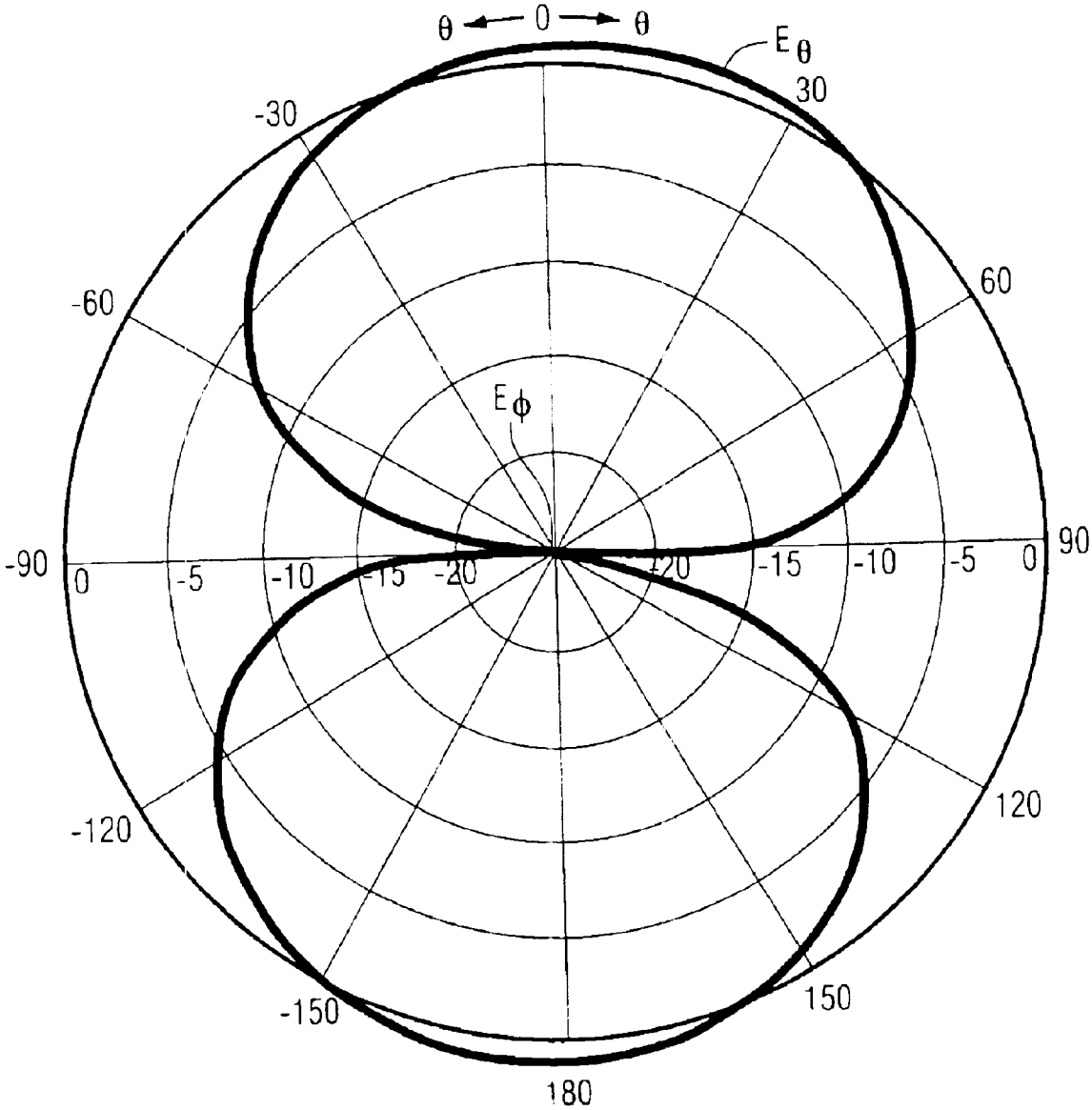
Figure 9:
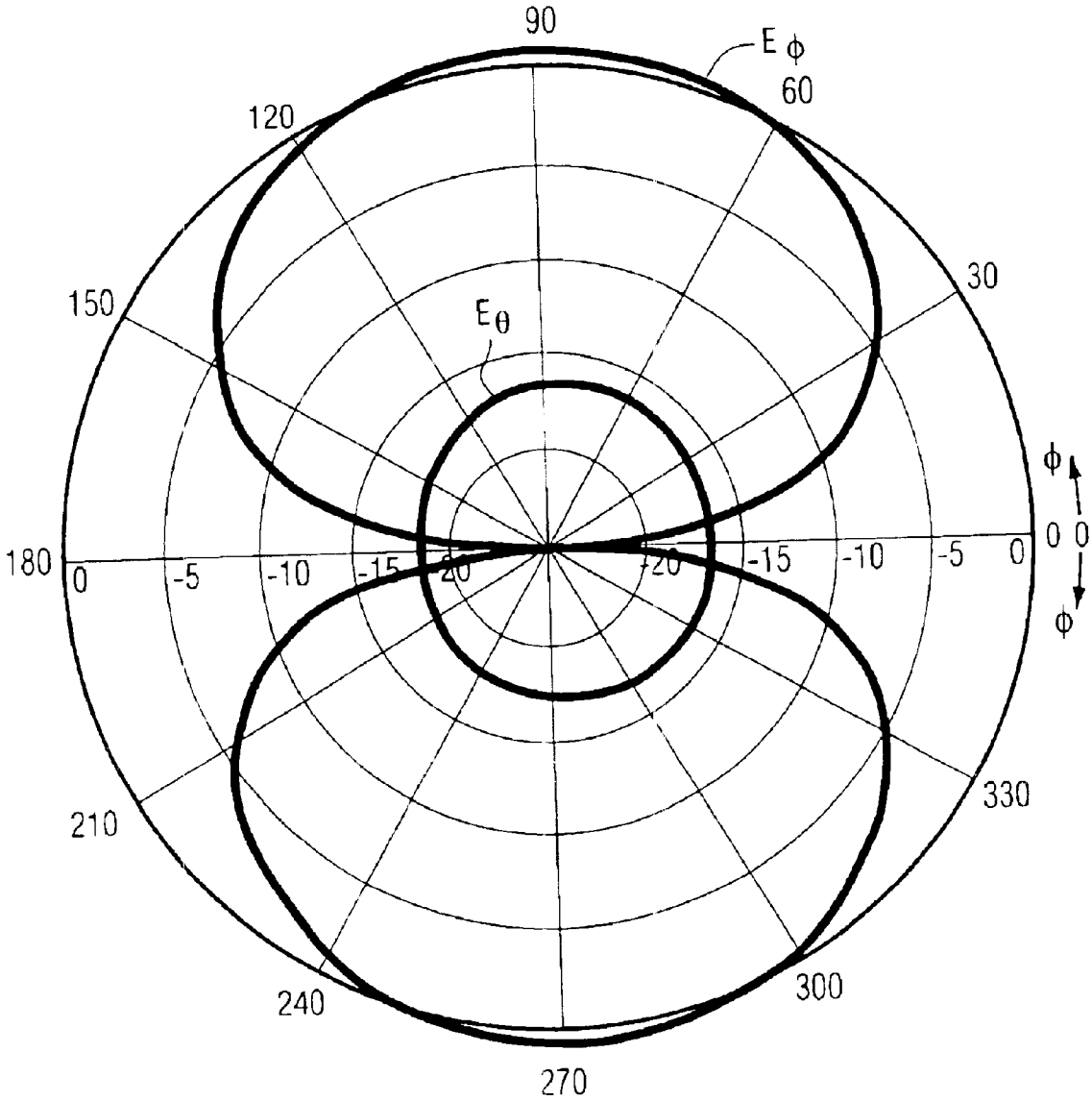

With reference to the coordinate system of FIG. 7, FIGS. 8 and 9 depict, respectively, the radiation patterns (at a frequency of about 850 MHz) in the theta (or y-z) plane with $\theta$ varying between 0 and 360° (FIG. 8), and the radiation pattern in the phi (or x-y) plane with $\Phi$ varying between 0 and 360° (FIG. 9). Both the theta and phi electric field vectors are illustrated in the Figures, i.e., $E_\theta$ and $E_\Phi$. In the various radiation pattern figures presented herein, the antenna 10 is oriented such that the ground plane 30 is parallel to the x-y plane.

Figure 10:
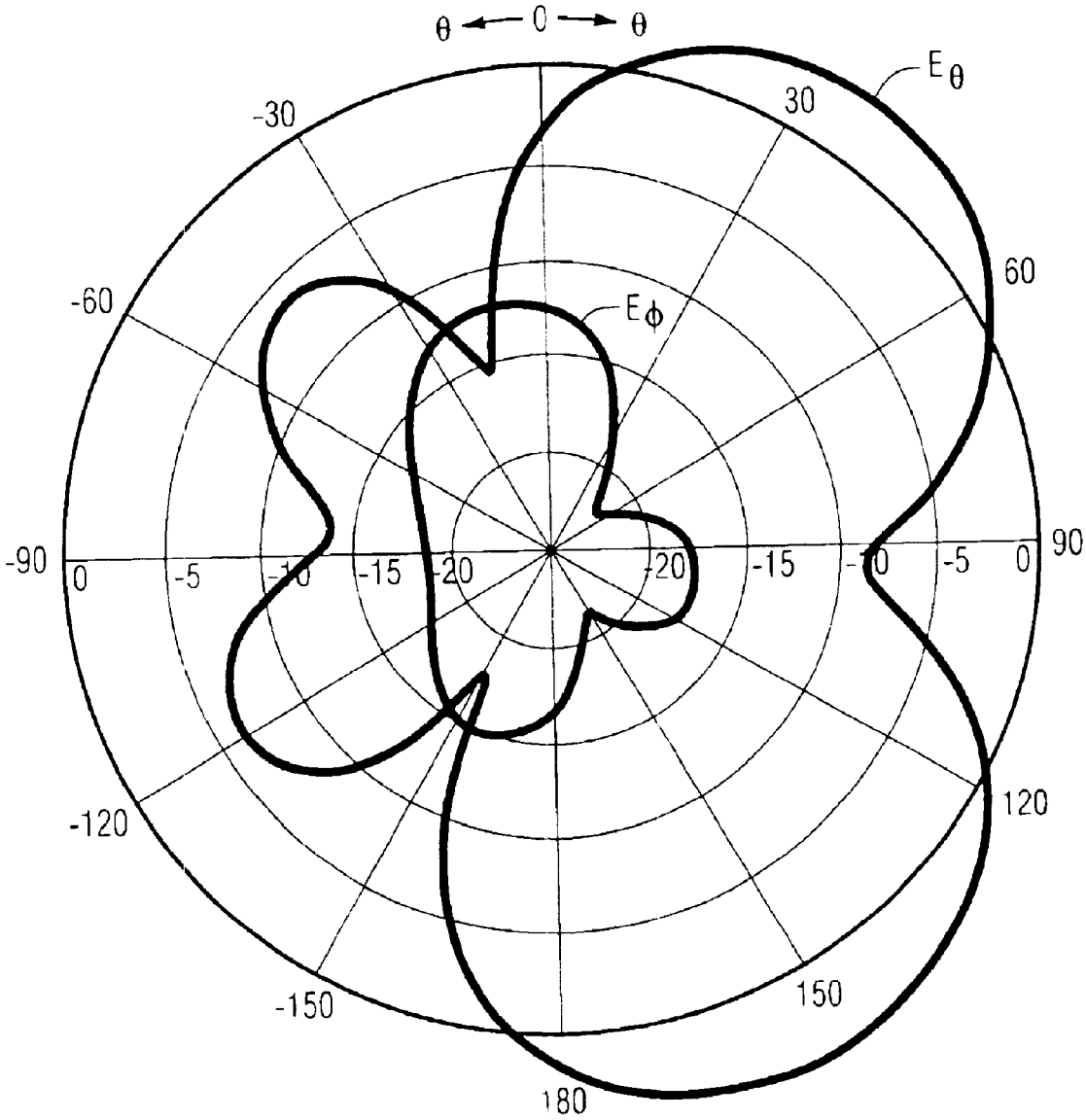
Figure 11:
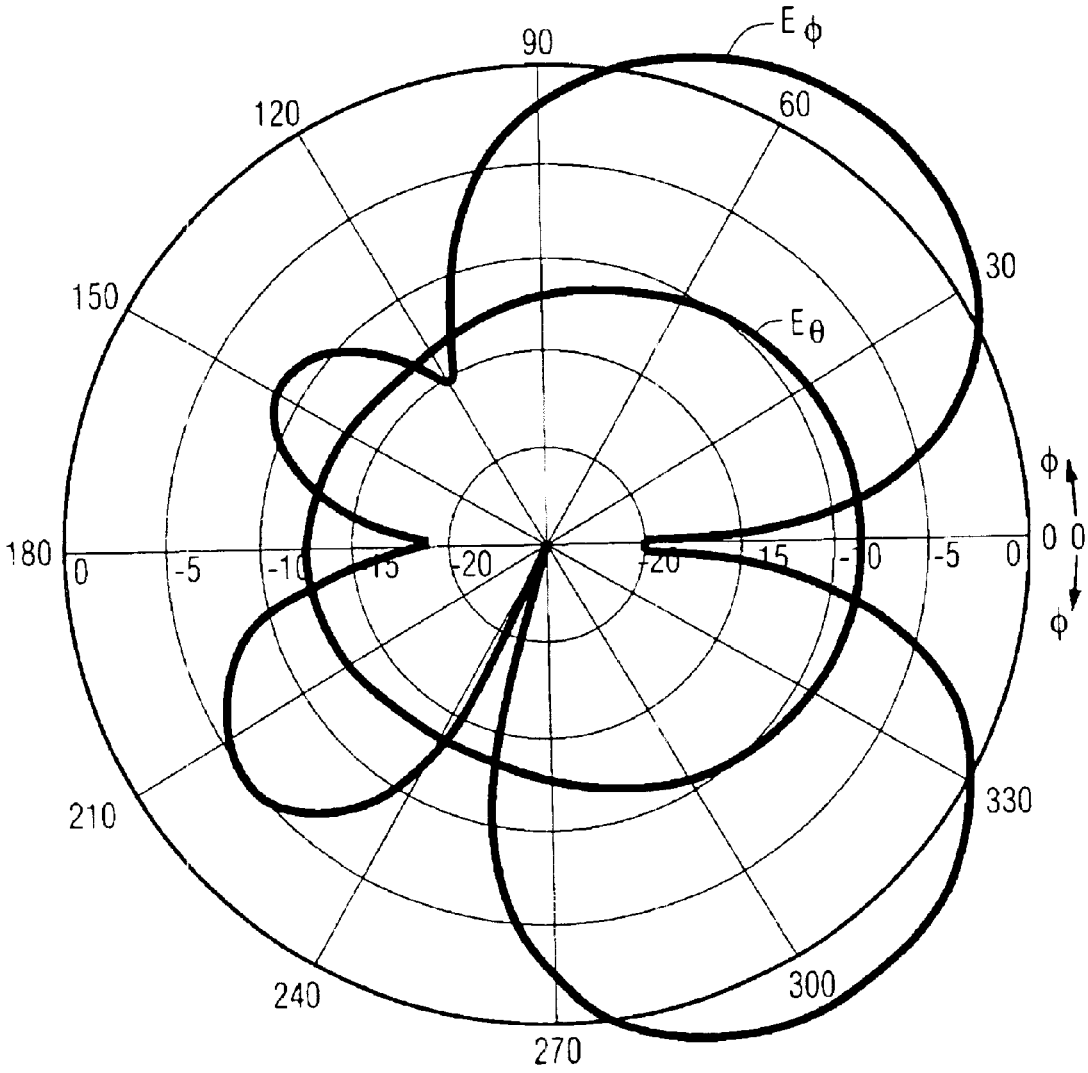

FIGS. 10 and 11 illustrate the same radiation patterns for the electric field vectors as FIGS. 8 and 9, but at a frequency of about 1.92 GHz.

Figure 12:
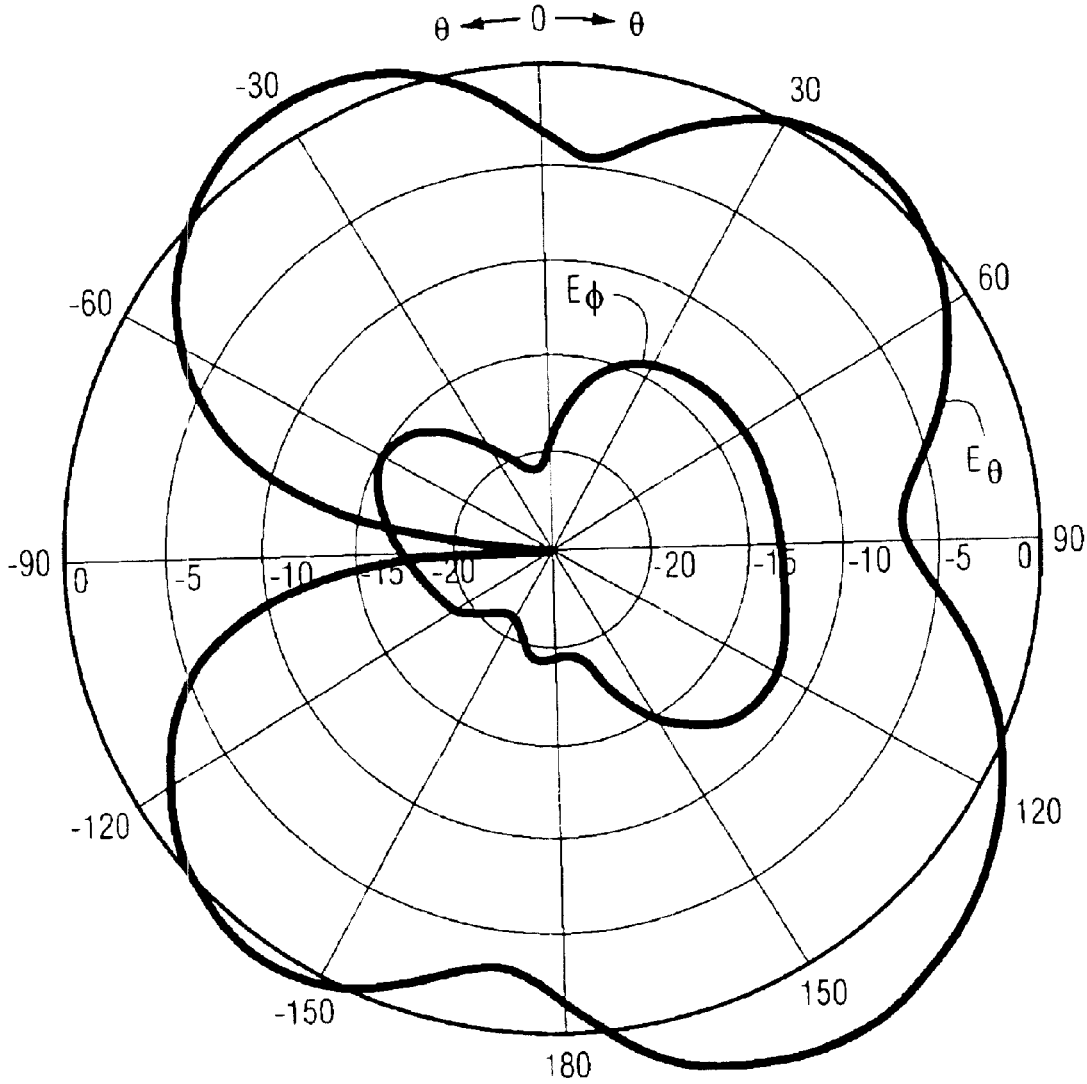
Figure 13:
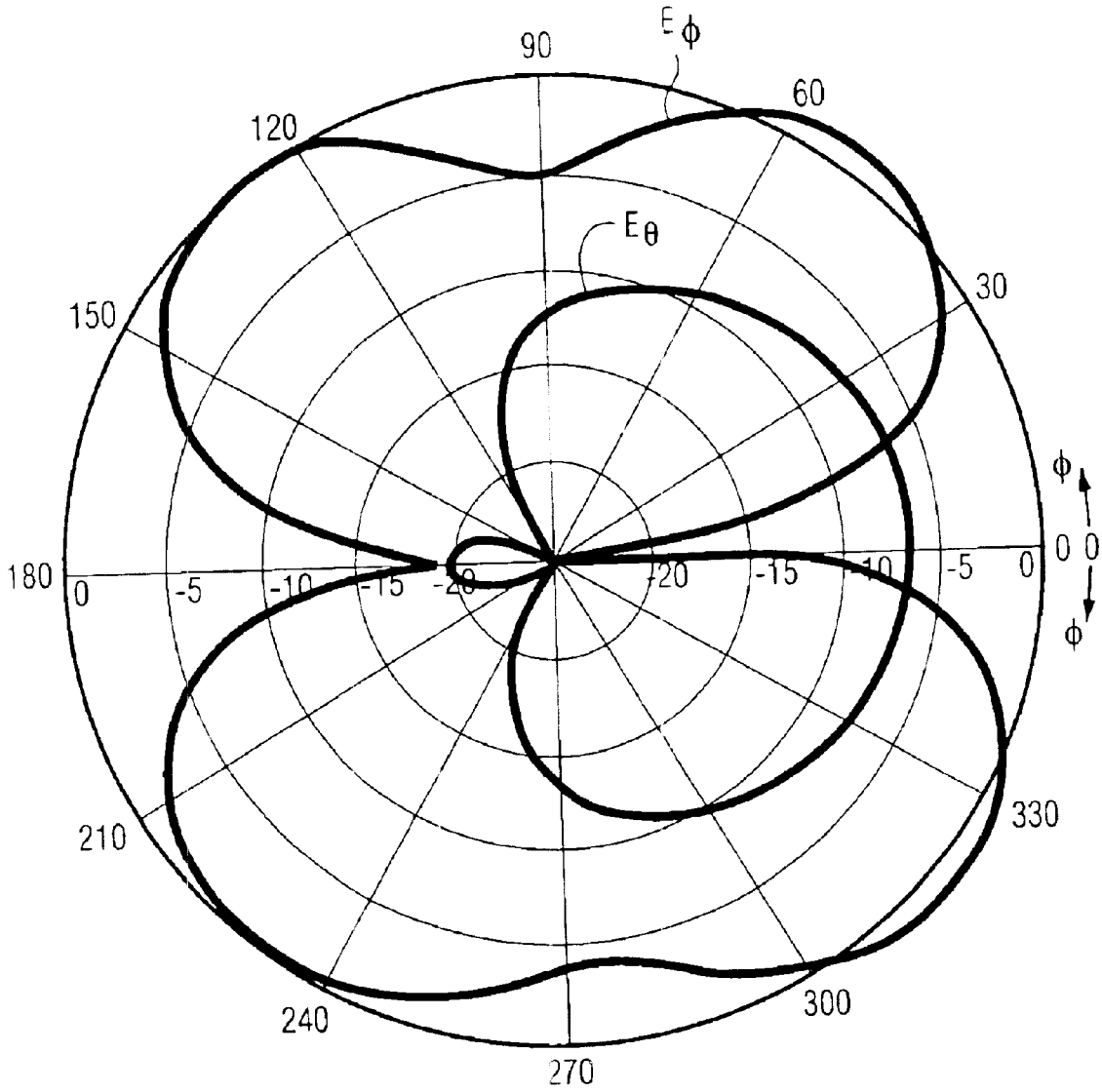

FIGS. 12 and 13 also illustrate the same radiation patterns for the electric field vectors at a frequency of about 2.48 GHz.

Figure 14:
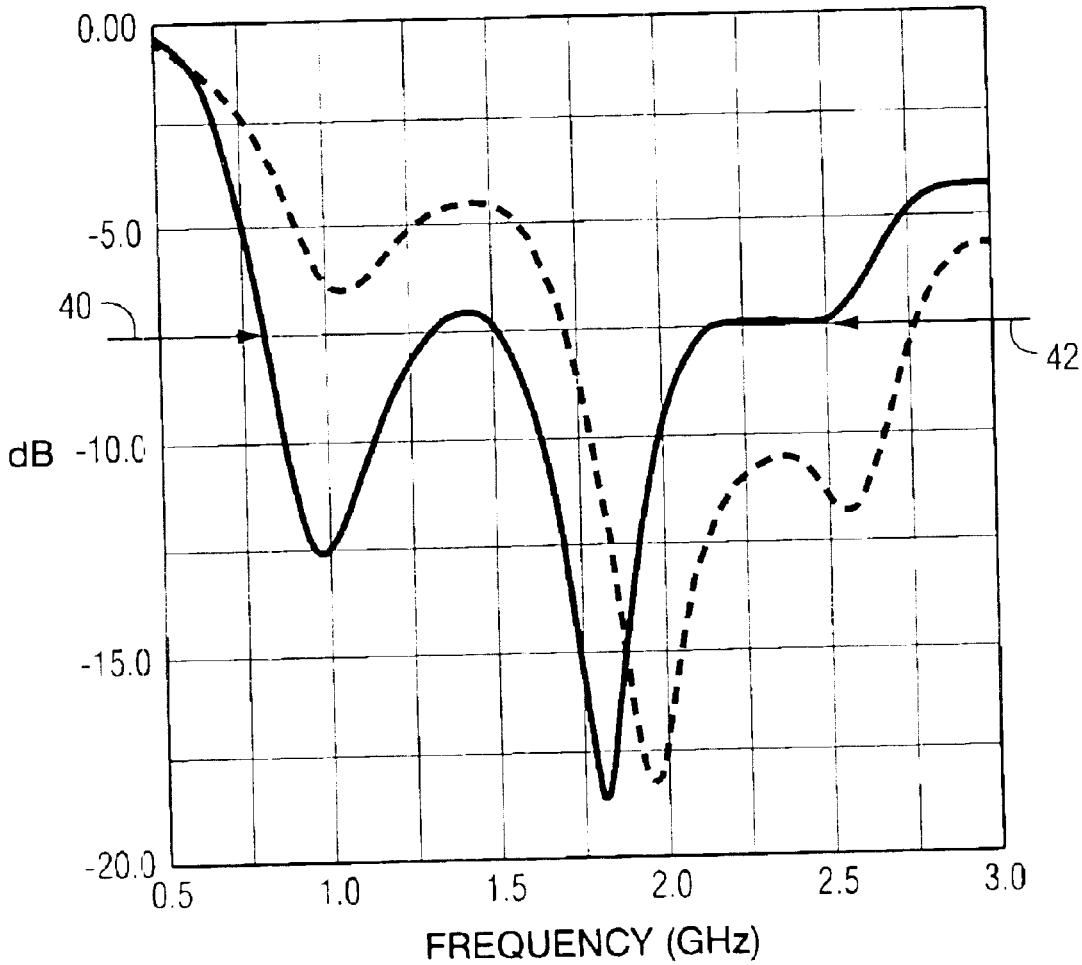

FIG. 14 illustrates the antenna return loss for both an exemplary ultra wideband antenna constructed according to the teachings of the present invention (solid line) and the prior art conventional monopole antenna (dashed line). The approximate bandwidth for the ultra wideband antenna is about 1.7 GHz, as indicated by the arrowheads 40 and 42 at about 800 MHz and 2.5 GHz, respectively. Thus the antenna operates in all of the wireless, cellular and global positioning system frequency bands, at a minimum efficiency of about 75%. In certain bands the efficiency is greater than 90%.

Figure 15:
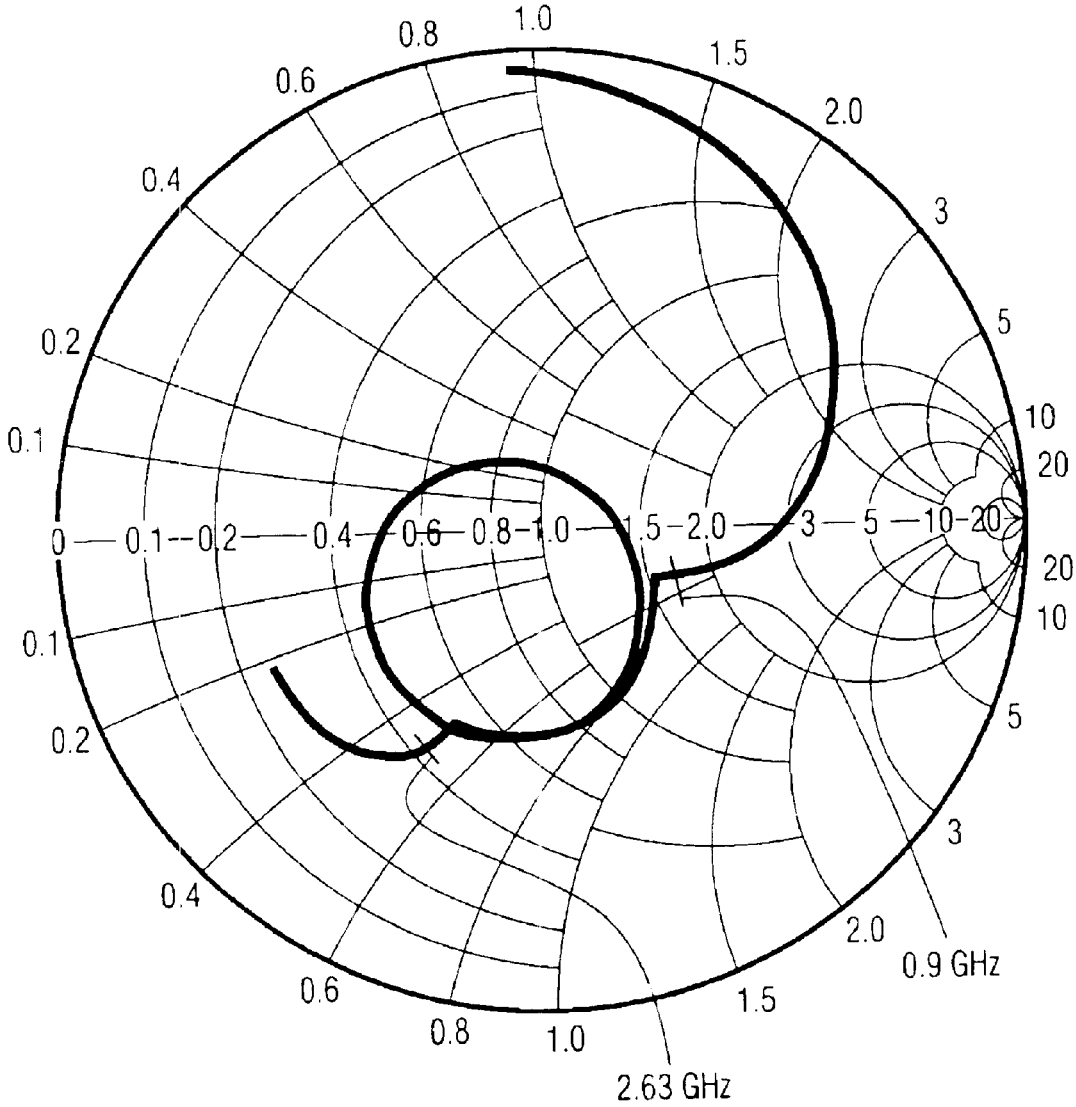

The Smith chart of FIG. 15 depicts the VSWR of an exemplary ultra wideband antenna. Between the approximate frequencies of 0.90 and 2.63 GHz (a bandwidth of 1.73 GHZ) the VSWR is in less than 2:1.

Figure 16:
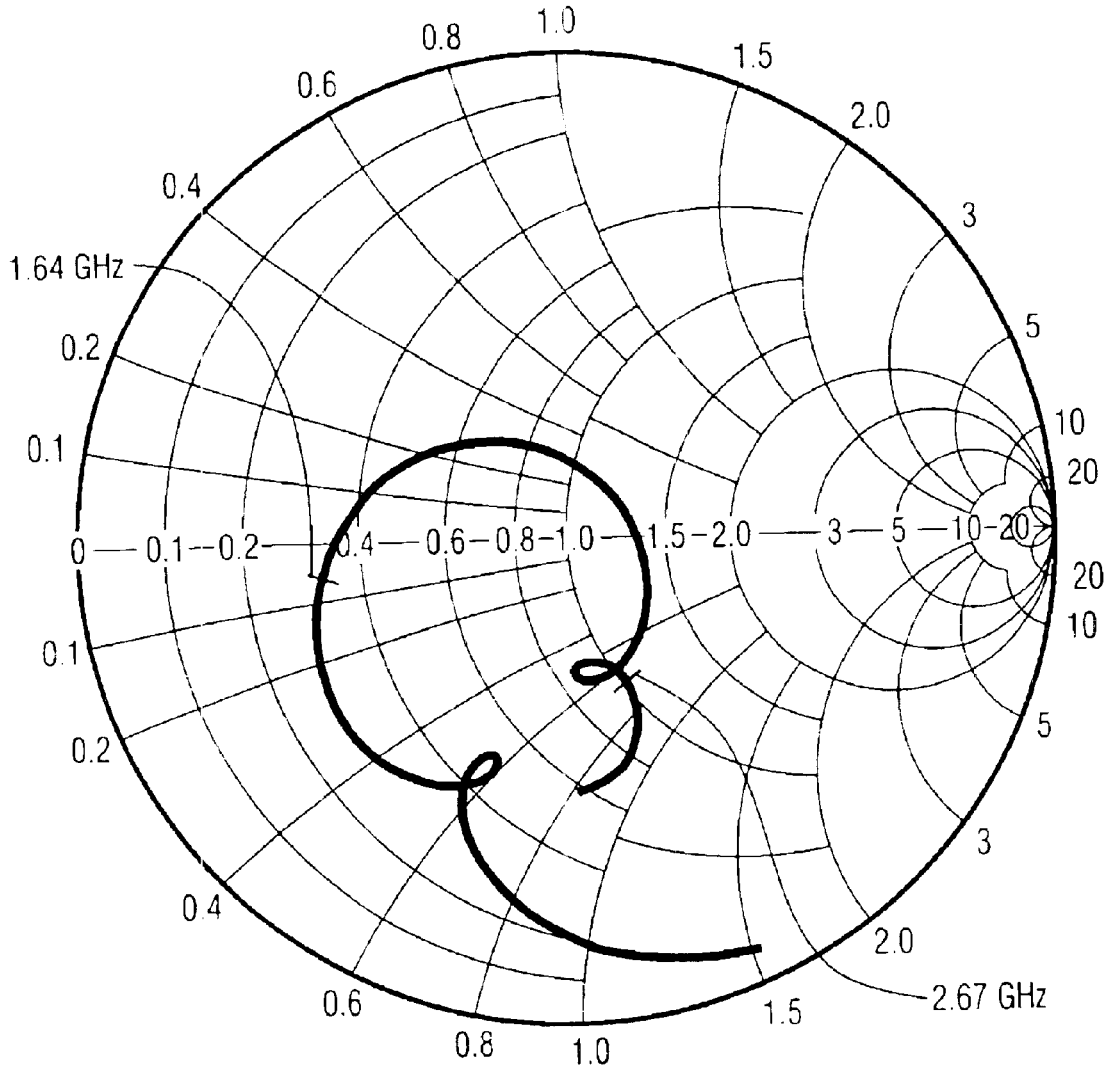

For a conventional monopole antenna, the Smith chart of FIG. 16 indicates a VSWR of less than 2:1 between the frequencies of about 1.64 to 2.67 GHz (for a bandwidth of about 1.03 GHz). Thus the exemplary ultra wideband antenna of the present invention has improved low-frequency performance compared with the prior art monopole, for similar space envelopes. Recognizing the shrinking antenna space available in handheld communications devices, improving low band performance while maintaining a space envelope similar to the prior art monopole antenna, is an important achievement.

Figure 17:
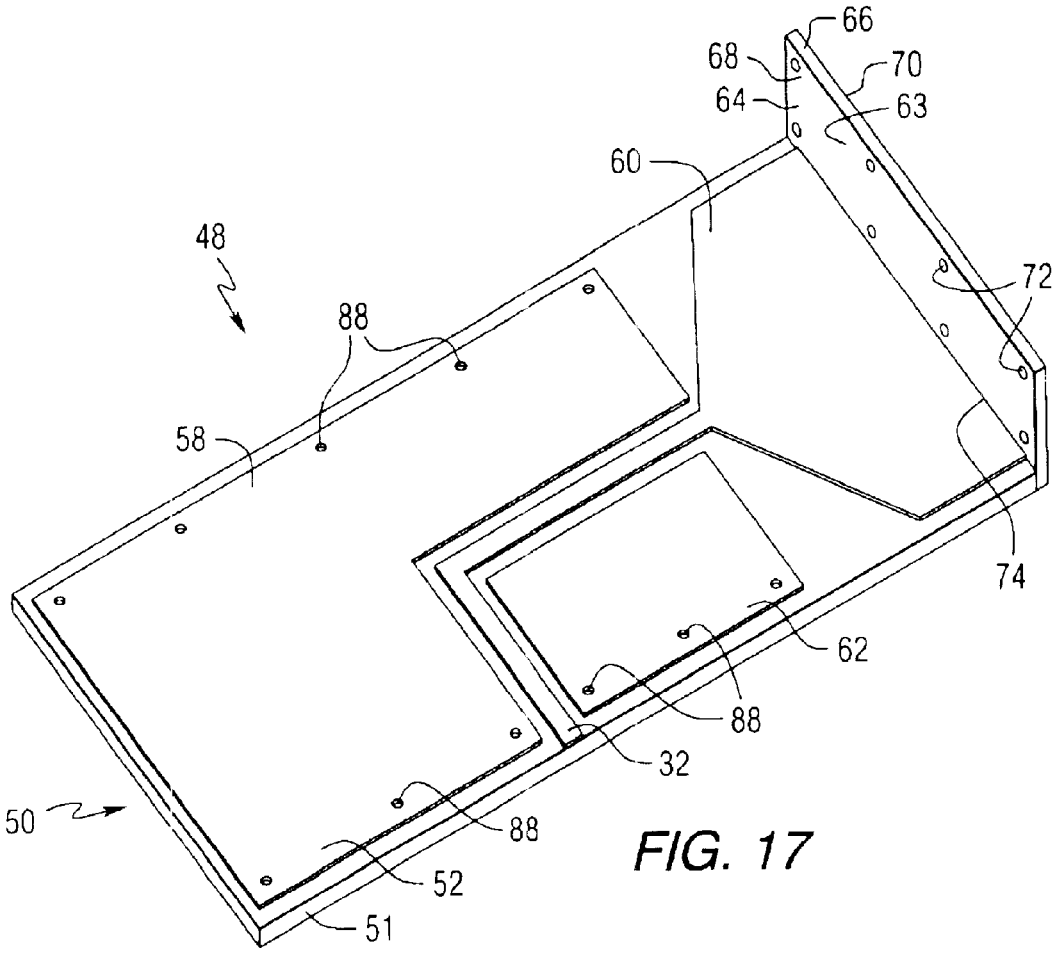
FIGS. 17 and 18 illustrate another embodiment of an antenna constructed according to the teachings of the present invention.
Figure 18:
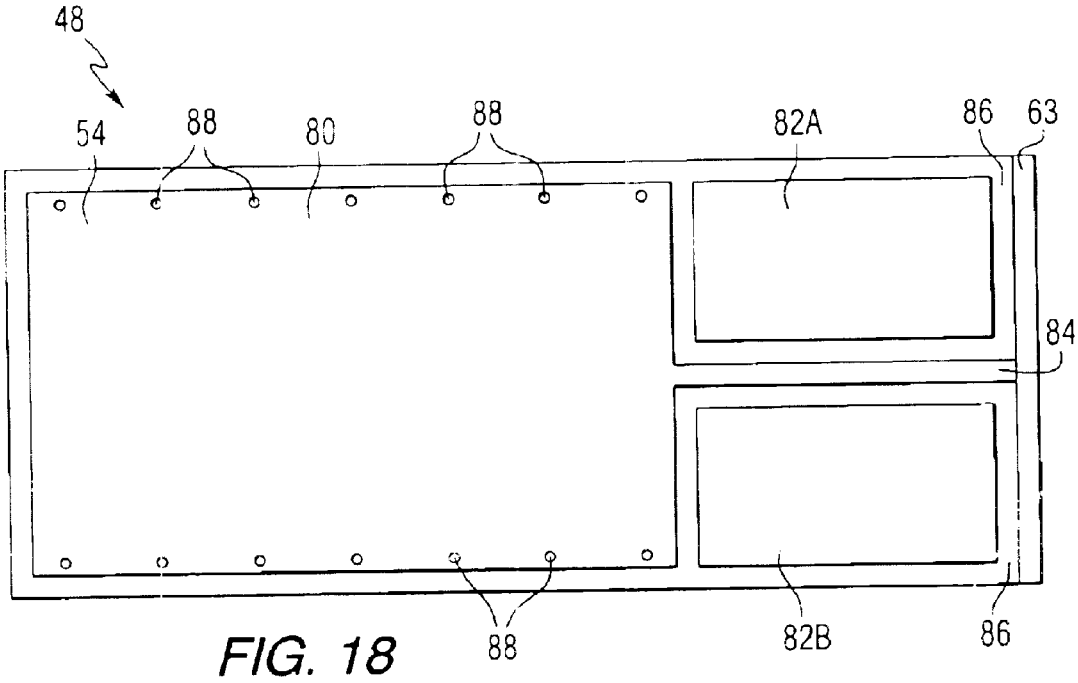

Another embodiment of an ultra wide bandwidth antenna 48 constructed according to the teachings of the present invention is illustrated in FIGS. 17 and 18. The antenna 48 is constructed from printed circuit board materials (e.g., a dielectric core substrate material with conductive material disposed on one or both surfaces thereof) and formed according to printed circuit board patterning technologies. The embodiment of FIGS. 17 and 18 comprises substantially the same antenna elements as the embodiments described above.

In the top view of FIG. 17, a substrate 50 comprises a dielectric core 51 and upper and lower sheet conductors 52 and 54 (see the bottom view of FIG. 18) disposed on opposing surfaces thereof. The upper sheet conductor 52 is patterned and etched, using known processing technologies, to form a top ground plane 58, a top radiator 60 connected to a signal feed 32, and a ground plane segment 62.

A side radiator 63 is formed from an upstanding substrate 64, disposed substantially perpendicular to the substrate 50, comprising a dielectric core 66 and sheet conductors 68 and 70 disposed on opposing surfaces of the core 66, and electrically connected by conductive vias 72. The top radiator 60 is electrically connected to the side radiator 63 along a line 74. In one embodiment the electrical connection is provided by a solder joint along the line 74.

In the bottom view of FIG. 18, the lower sheet conductor 54 is patterned to form a ground plane 80 and two bottom radiator regions 82A and 82B. A meanderline 84 is electrically connected between the side radiator 63 and the ground plane 80. The ground planes 58, 62 and 80 are interconnected by conductive vias 88.

In a departure from the embodiments described above, in an embodiment of the antenna 48 illustrated in FIGS. 17 and 18, a gap 86 (see FIG. 18) separates the conductive surfaces of the side radiator 63 from the bottom radiator regions 82A and 82B. The gap 86 forms a capacitance that tunes out the inductive reactance of the other antenna elements. The top radiator 60 operates as a broadband monopole above a ground plane, at high frequencies as established by the side radiator 63 and the meanderline 84. At low frequencies the top radiator 60, the side radiator 63 and the meanderline 84 are resonant over a broad band as the meanderline 84 compensates the reactance of the other antenna elements as the frequency varies.

In another embodiment the gap 86 is omitted and the side radiator 63 is electrically connected to the bottom radiator regions 82A and 82B.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof. For example, different sized and shaped elements can be employed to form an antenna according to the teachings of the present invention. Therefore, it is intended that the invention not be limited to the particular embodiment disclosed as the best mode contemplated for carrying out this invention, but that the invention will include all embodiments falling within the scope of the appended claims.

What is claimed is:

1. An antenna for connection to a ground plane and a source terminal, comprising:

top and bottom substantially parallel vertically-spaced apart planar elements, wherein the top element comprises first and second substantially parallel edges, and wherein the bottom element comprises first and second substantially parallel edges, and wherein the first edge of the top element and the first edge of the bottom element are substantially vertically aligned, and wherein the second edge of the top element extends beyond the second edge of the bottom element, the second edge of the top element for connection to the source terminal;

a side planar element disposed substantially perpendicular to the top element and the bottom element, wherein the side element is connected to the first edge of the top element and the first edge of the bottom element; and a meanderline conductor comprising a first end for connecting to the ground plane and a second end connected to the second edge of the bottom element, wherein the meanderline conductor extends from the second end toward the second edge of the top element for terminating in the first end, and wherein a width of the meanderline conductor is less than a width of the top element.

2. The antenna of claim 1 wherein the top element, the bottom element, and the side element radiate and receive electromagnetic energy.

3. The antenna of claim 1 wherein the meanderline conductor comprises a substantially L-shaped conductor further comprising a short leg and a long leg, wherein a terminal end of the short leg comprises the second end of the meanderline conductor, and wherein the short leg extends upwardly from the bottom element in the direction of the top element, and wherein the long leg extends proximate along and spaced apart from the top element.

4. The antenna of claim 3 wherein a dielectric material is disposed within an area wherein the meanderline conductor is spaced apart from the top element.

5. The antenna of claim 4 wherein the dielectric material comprises air.

6. The antenna of claim 4 wherein the dielectric material imparts slow wave characteristics to the meanderline conductor.

7. The antenna of claim 1 wherein the bottom element further comprises a notch formed in the second edge thereof, wherein the notch comprises a notch edge substantially parallel to the second edge of the bottom element, and wherein the second end of the meanderline conductor is connected to the notch edge.

8. The antenna of claim 1 wherein the second edge of the top element comprises a tapered edge such that a width of the top element narrows in a direction away from the first edge of the top element.

9. The antenna of claim 8 wherein the tapered edge comprises a parallel segment parallel to the first edge of the top element and further comprises first and second angled segments forming an angle with the parallel segment, wherein the angle is determined in response to desired resonant frequency characteristics of the antenna.

10. The antenna of claim 1 further comprising a ground plane substantially parallel to the top element and connected to the first end of the meanderline conductor.

11. The antenna of claim 10 wherein the top element extends beyond the ground plane.

12. The antenna of claim 11 wherein a distance that the top element extends beyond the ground plane is determined in response to desired frequency response characteristics of the antenna.

13. The antenna of claim 1 wherein a length of the bottom element relative to the length of the top element is determined in response to desired frequency response characteristics of the antenna.

14. The antenna of claim 1 wherein the top element comprises a first generally rectangular region and a second generally triangular region, and wherein the first edge of the top element forms an edge of the rectangular region and the second edge of the top element forms an edge of the triangular region.

15. An unbalanced U-shaped antenna structure comprising a source terminal and a ground terminal, the antenna structure comprising:

a short leg planar element;

a long leg planar element;

an intermediate leg planar element connecting the long leg element and the short leg element in a substantially perpendicular orientation;

an elongated meanderline conductor having a first end connected to a free end of the short leg element and extending in a direction of the free end of the long element for terminating in a second end comprising the ground terminal, and wherein a width of the elongated meanderline conductor is less than a width of the long planar element; and wherein the free end of the long leg element comprises the source terminal.

16. The antenna structure of claim 15 further comprising a ground plane connected to the ground terminal and extending substantially parallel to the short and the long leg elements.

17. An antenna comprising;

a first substrate comprising a dielectric core, first and second opposing conductive surfaces and a first edge;

wherein the first conductive surface comprises a first ground plane and a first element in insulative relation to the first ground plane;

wherein the second conductive surface comprises a second ground plane, a second element in insulative relation to the second ground plane, and a meanderline conductor connected to the second ground plane and comprising a terminal end adjacent the first edge of the first substrate;

wherein the first and the second ground planes are electrically connected; p1 a third element disposed substantially perpendicular to the first edge of the first substrate and extending above the first substrate, wherein the third element is electrically connected to the first element and to the terminal end of the meanderline conductor.

18. The antenna of claim 17 wherein the third element is spaced apart from the second element to form an insulating gap therebetween.

19. The antenna of claim 17 wherein the third element is electrically connected to the second element.

20. The antenna of claim 17 wherein the second element is bifurcated by the meanderline conductor.

21. The antenna of claim 17 wherein the first element comprises a top radiating element, the second element comprises a bottom radiating element and the third element comprises a side radiating element.

22. The antenna of claim 17 wherein the third element comprises a second substrate further comprising a dielectric core and third and fourth opposing conductive surfaces, wherein the third and the fourth conductive surfaces are electrically connected.

23. The antenna of claim 17 wherein the first element comprises a first element edge aligned with the first edge of the first substrate and a second tapered element edge spaced-apart from the first element edge.

24. The antenna of claim 23 further adapted for connection to a source terminal at the second tapered element edge.

25. An antenna for connecting to a ground plane and a source terminal, comprising:

a top element for disposition in a spaced-apart orientation relative to the ground plane wherein a first region of the top element overlies the ground plane and a second region of the top element extends beyond an edge of the ground plane, wherein the top element comprises a feed terminal for the antenna;

a side element connected to an edge of the second region;

a bottom element connected to an edge of the side element;

wherein the top element, the side element and the bottom element form a U-shaped structure having an elongated leg comprising the top element; and a meanderline conductor having a first end connected to an edge of the side element and a second end for connecting to the ground plane, wherein the meanderline conductor extends parallel to and spaced apart from the top element, and wherein a width of the meanderline conductor is less than a width of the top element.

26. The antenna of claim 25 wherein the first region comprises a tapered first region with a direction of the taper toward the feed terminal.

* * * * *